United States Patent [19]

Barbier et al.

[11] Patent Number: 4,878,060

[45] Date of Patent: Oct. 31, 1989

[54] MICROWAVE PLANE ANTENNA WITH SUSPENDED SUBSTRATE SYSTEM OF LINES AND METHOD FOR MANUFACTURING A COMPONENT

[75] Inventors: Pascal Barbier, Saint Maurice; Francis Falgat; Alain Sorel, both of Evreuz, all of France

[73] Assignee: U.S. Philips Corporation, New York, N.Y.

[21] Appl. No.: 939,583

[22] Filed: Dec. 9, 1986

[30] Foreign Application Priority Data

Dec. 20, 1985 [FR] France ..... 85 18923

[51] Int. Cl.[4] ..... H01Q 13/02

[52] U.S. Cl. ..... 343/778; 343/786; 343/797

[58] Field of Search ..... 343/700 MS File, 786, 343/797, 778

[56] References Cited

U.S. PATENT DOCUMENTS

| | | | |
|---|---|---|---|
| 4,486,758 | 12/1984 | de Rende | 343/700 MS File |
| 4,527,165 | 7/1985 | de Ronde | 343/786 |
| 4,614,947 | 9/1986 | Rammos | 343/786 |
| 4,626,865 | 12/1986 | Rammos | 343/786 |
| 4,644,362 | 2/1987 | Rammos | 343/786 |

*Primary Examiner*—William L. Sikes
*Assistant Examiner*—Doris J. Johnson
*Attorney, Agent, or Firm*—Robert J. Kraus

[57] ABSTRACT

Multi-element microwave plane antenna formed from at least two metallic sheets (156, 157) on which separating studs (4, 19) are silk-screen printed and on which is inserted at least one block (50) of waveguides (2). The assembly of two such sheets forms a sandwich enclosing a printed circuit (195) carrying microwave lines which emerge into the waveguide.

10 Claims, 3 Drawing Sheets

MICROWAVE PLANE ANTENNA WITH SUSPENDED SUBSTRATE SYSTEM OF LINES AND METHOD FOR MANUFACTURING A COMPONENT

BACKGROUND OF THE INVENTION

The present invention relates to a microwave plane antenna formed from a number of radiating elements (receivers or, according to the principle of reciprocity of antennas, transmitters), having at least one system of planar lines placed on a sheet of dielectric of "completely suspended substrate lines' type enclosed between devices at least locally metallic or metallized in which cut-outs placed facing each other are bored in order to form elementary open or closed waveguides. The ends of the central conductors of the planar lines are placed inside these waveguides in order to form probes which produce a coupling enabling the reception (or transmission) of microwave signals. Studs are provided to hold the sheet of dielectric at a certain distance from the said devices.

The present invention also relates to a method of manufacturing a component of the antenna.

Such antennas are used in particular for receiving satellite television transmissions at a frequency of about 12 GHz.

A microwave plane antenna including an assembly of such elements has been described in French patent application No. 2544920, corresponding to U.S. Pat. No. 4,614,947. In it there is in particular described an arrangement enabling the transmission lines forming the antenna feed system or systems to be supported. Each of the systems of microwave lines is formed by a printed circuit deposited on a thin sheet of dielectric serving as a substrate enclosed between two metallic plates or between two metallized dielectric plates. Each system is placed in such a way that the ends of the central conductors of the lines are facing square cut-outs bored in each of the plates which enclose it respectively in order to produce the coupling between the lines and the cut-outs. Each sheet of dielectric carrying the system of printed central conductors of the microwave lines is supported between the plates which enclose it by positioning studs located on the surfaces of these plates, facing each other and on either side of this sheet, these studs also being placed, with respect to this sheet, in spaces having no printed circuits.

Such an antenna has the disadvantage that the plates, forming both the main framework of the antenna and the waveguide system, must be very rigid and have high dimensional accuracy. Metal plates with such a complex structure are expensive and also very heavy. Plates made from metallized plastic material have heat expansion characteristics that are not appropriate for the production of a large-sized antenna which must operate equally well at −40° as in the summer sunshine.

SUMMARY OF THE INVENTION

In order to remedy these disadvantages, the antenna according to the invention is particularly characterized in that the "plates' in it are replaced by composite devices each formed by a thin sheet bored with cut-outs, on one surface of which is applied at least one block forming a number of waveguides, and on the other surface of which are located separating studs, and in that the assembly of sheets is supported by a single rigid chassis.

Thus the thin and pierced sheet has a very simple shape and can therefore be produced economically, for example by punching. The block forming a number of waveguides is inserted on this sheet and held by it, it is not therefore subject to strict mechanical precision requirements and therefore can be produced economically. The term "thin sheet' is understood to mean that the sheet has a thickness that is too small to provide sufficient rigidity by itself. It is relatively flexible, and is held in position by the chassis, which therefore forms a kind of slab to hold the sheets flat. There is now, therefore, a single rigid part: the chassis, which holds several sheets, instead of the several complex self-supporting plates of the prior art.

The antenna according to the prior art also has the disadvantage that, as the studs can only be placed at positions where the sheet has no printed circuit, the next alternative is imposed: either a large number of studs of small dimension are used, which is costly as a mould for moulding such a part is difficult to produce, or else few studs are used with the disadvantage that the surface of the sections of sheets suspended between the studs is large and because of this it is not well held in the ideal position in all places: in the presence of unfavorable climatic conditions, the sheet can expand in proportions that are large with respect to the support devices, and the resultant displacement degrades the performance of the antenna.

This problem is completely solved by the antenna according to the invention, which in a preferred embodiment, has separating studs formed by areas of dielectric material deposited by silk-screen printing, whose design represents, practically, on the outside of the surfaces corresponding with the cut-outs in the sheets, a similar design, but in negative, to that of the system of lines, in which these lines would be enlarged.

This embodiment is easily implemented since the sheets, which are relatively thin and of constant thickness, are easily inserted into a common silk-screen printing machine and it enables a large number of studs of complex shape to be obtained without difficulty. In addition, these studs made from dielectric material hardly disturb the characteristic impedance of the lines which pass near to them.

It is rather difficult to find enough space to house a sufficient density of studs for good support of the dielectric sheets. That is why it is advantageous to produce the cut-outs in the sheets in a circular or cross shape, in order to save the space in the angles in order to locate studs there, a space which does not exist with the squares of the prior art.

The dielectric material is advantageously loaded with particles, which are themselves made from dielectric material, these particles being for example balls, possibly hollow, made from glass or plastic. In this way the studs have a better resistance to crushing and their dielectric constant is lower. In addition, the rheological characteristics of the material are better suited to deposits of large thickness, and the material is cheaper (the particles are much less expensive than a their binder).

Advantageously the particles are transparent. This facilitates the penetration of light when a material that can be polymerized in ultra-violet rays is used.

In order to simplify the manufacturing tools and above all to eliminate relative expansion problems, a block of waveguides is advantageously subdivided into several blocks fixed independently from each other onto a same pierced sheet. Each of these blocks itself forms a number of waveguides.

In an advantageous variant, a block forming a number of waveguides is formed of two series of plane walls, the two series being assembled in order to form a matrix of cells.

This arrangement enables a very large reduction in the cost of the waveguide blocks while retaining correct performance.

In an advantageous variant, the blocks of closed waveguides are formed by cut-outs directly cut into a surface of the chassis applied to the rear surface. This arrangement simplifies the production of the antenna since the manufacture and assembly of the blocks of closed waveguides is saved.

In addition, as the antenna is housed in a protective casing, the rear wall of this casing advantageously forms the abovementioned chassis. This arrangement is economical since a same mechanical part fulfils two functions at the same time.

In order to facilitate the manufacture of the antenna and to improve its performance, a preferred process for manufacturing a sheet provided with studs consists in silk-screen printing the studs using a dielectric material that can be polymerized and in only partially polymerizing it. Thus, during the assembly of the components of the antenna, the material remains adhesive and the components are fixed to each other as soon as they are assembled. The adhesion of the parts improves their mechanical behaviour and obliges the dielectric sheets to "follow' the sheets in expansion. This process is simpler than that according to which the material of the studs would be traditionally polymerized in order to subsequently deposit adhesive on them.

BRIEF DESCRIPTION OF THE DRAWING

The following description, given with reference to the appended drawings describing non-limiting examples, will give a good understanding of how the invention can be embodied.

DESCRIPTION OF THE PREFERRED EMBODIMENT

Figure 1:
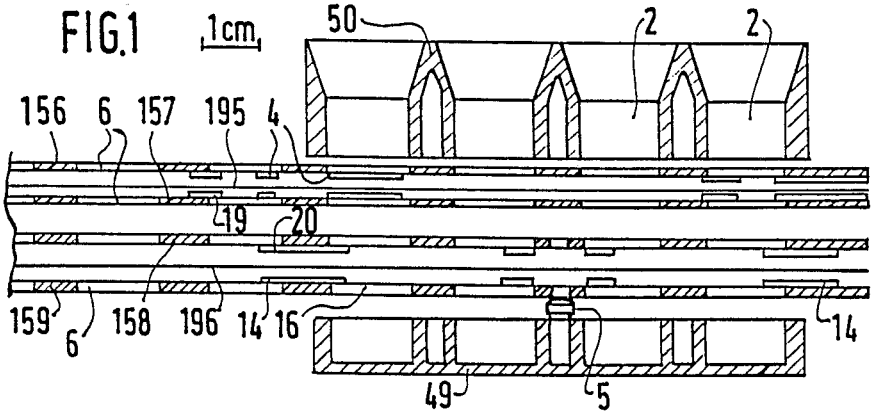
FIG. 1 shows in cross-section part of an antenna including two systems of microwave lines, produced according to the invention.
Figure 2:
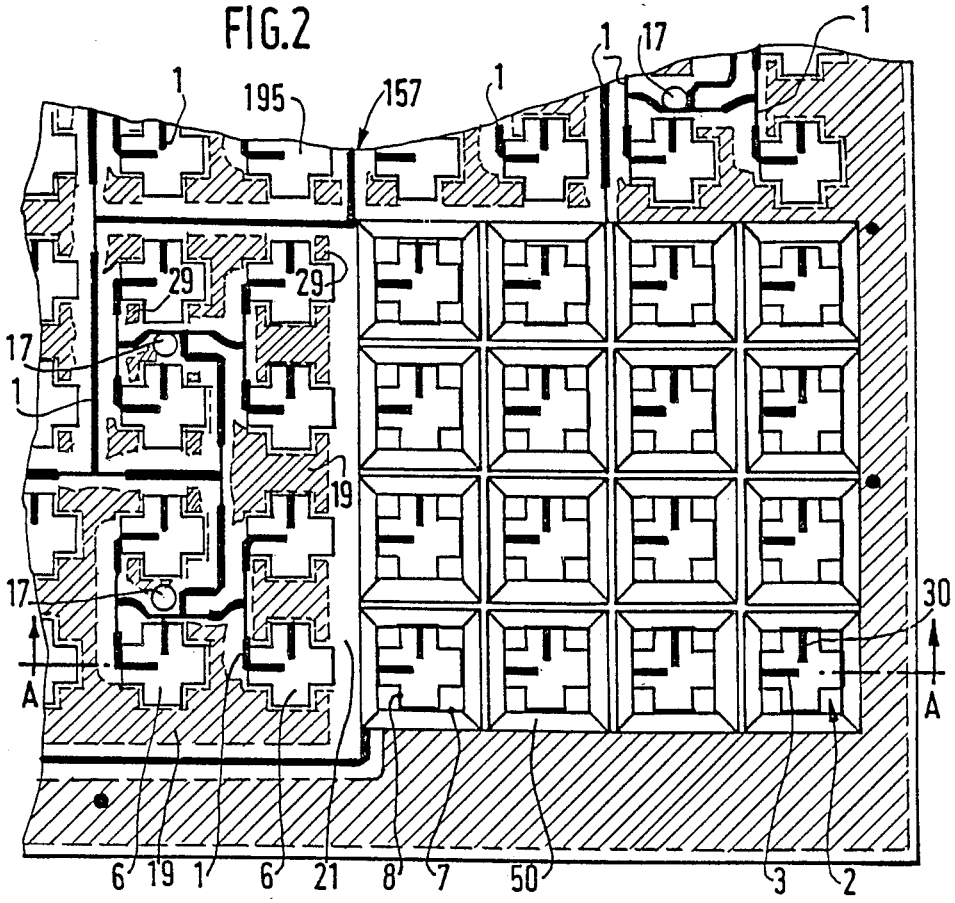
FIG. 2 shows a plan view of the same antenna part.

FIG. 1, which is a cross-section view along line A of FIG. 2, shows components of an antenna separated from each other for better clarity of the Figure. The antenna is formed from an system of planar lines placed on a dielectric sheet 195 and a second similar system placed on a dielectric sheet 196, these systems are each enclosed between devices made from metallic or metallized material. The lines carried by sheets 195 and 196 are not shown, because their thickness at the scale of the drawing is too small for them to be visible. One of these devices includes the elements referenced 50 and 156, another of these devices includes the elements referenced 49 and 159. In all of these devices there are pierced cut-outs which form the elementary waveguides 2, into which emerge the ends of the lines, as will appear more clearly in the description of FIG. 2. Studs, 4, 14, are provided to hold the sheets of dielectric 195, 196, at a certain distance from the said devices.

According to the invention these devices are formed from a plane sheet 156 which is pierced with holes 6, on one surface of which is applied a block 50 forming a number of waveguides 2, and on the other surface of which are situated separating studs 4. Another of these devices is formed similarly by sheet 159 pierced with holes 6, block 49 forming waveguides, and separating studs 14.

In the example described here, the antenna also includes two additional sheets 157, 158, each provided with spacing studs 19, 20. If it were required to space the two sheets of dielectric 195, 196, it would be easy to place, between sheets 157, 158, additional waveguide blocks similar to blocks 50, which would then form a third device according to the invention. The sheets 156, 157, 158, 159 are produced from aluminum and have a thickness of 1 mm, the blocks 49, 50 are moulded, for example in thermoplastic material, known as "ABS", and metallized, and the dielectric sheets carrying the systems of lines are produced from Mylar sheets of thickness 70 microns covered with a copper sheet of thickness 35 microns which is etched in order to form the lines. It is possible to use even smaller thicknesses for the dielectric sheet, for the purpose of further reducing losses; for example a Kapton sheet of thickness 25 microns could be used, but this is more expensive than the Mylar sheet. The material used to form the studs is advantageously loaded with particles of dielectric material; these particles are for example balls, possibly hollow, made from glass or plastic material. The silk-screen printed separating studs 4, 14, 19, 20 are 0.8 mm thick. They are produced by means of silk-screen printing using a screen of adequate thickness; the screen is formed from a sheet of meshes that are large enough to allow the above-mentioned balls to pass through, covered with one or more layers providing the desired thickness, made from photo-sensitive material, and the patterns of the studs are obtained, by means of photographic processing, on this screen.

FIG. 2 shows the same components as FIG. 1, but without the upper sheet 156 in order to show the array of lines 1. These lines in general are 1.8 mm wide. They have narrower parts at the "T' connection points in order to match impedances. The silk-screen printed studs 19, 29 of the sheet 157 can be seen through the transparent Mylar sheet 195.

The cut-outs 6 are cross-shaped, while the waveguides 2, are of square cross-section. The references 7 and 8 showing a point on the perimeter of the waveguide and a point on the perimeter of the cut-out respectively show how they are placed with respect to each other. Cut-outs of circular shape can also be produced. But the cross shape is more advantageous in the case of a wave with two orthogonal polarizations. The separating studs 19, seen through the sheet 195, are shown by cross-hatched areas surrounded by dotted lines. The silk-screen printed areas forming these studs practically represent a negative image of the array of lines, an image in which these lines would be enlarged. By the term "negative" it is understood that the impervious material in the silk screen is located material in the places where the lines are present. An image of the silk-screen-printed areas can be obtained by using conventional computer-aided drawing equipment. With this equipment it is possible to draw strips having the same median line as the microwave lines, but wider, and to add to it the array of cross-shaped cut-outs. In the absence of such equipment, it is possible to produce the same drawing. In this case a negative of the lines shown transparent on a black backgroud must be used and a duplicate negative made from it by moving the negative in all directions during the exposure. The amplitude of this movement is of course equal to the desired enlargement for the lines. In this way a drawing in black of the enlarged lines is obtained which is then sufficient to superimpose on the drawing in black of the cut-outs.

Reference numeral 3 indicates the end of one line of the array carried by sheet 195 and this end emerges into waveguide 2 in order to produce a coupling probe enabling the reception of microwave signals; reference numeral 30 similarly indicates a probe of the array carried by the dielectric sheet 196. When the cut-outs are cross-shaped as here, the width of the probes must be slightly increased with respect to that of the lines. It is approximately 2.5 mm.

The references 29 indicate studs placed adjacent the corners of the cut-outs, studs which would have been impossible to place with square cut-outs.

The interval betwen two rows of cut-outs in both directions is 23 mm.

Only one waveguide block 50 has been shown in FIG. 2 in order to leave the array of lines visible at the side of this block. It is obvious that other waveguide blocks similar to block 50 must be mounted over the entire surface of the antenna; these blocks are separate from each other which enables a reduction in the effect of different expansions of the plastic material of these blocks on the one hand and of the aluminium forming the sheets on the other hand. The waveguide blocks 50 are provided with locating pins such as 5 on FIG. 1, which enable the fixing of the blocks 50 onto the sheets. Holes 17, intended to receive these pins, are visible in FIG. 2.

The repetitive configuration of the array of lines enables easy reconstruction of the rest of the antenna which is not shown in the figure. An antenna can for example be formed by sixteen blocks 50 each including sixteen waveguides 2 arranged in a rectangle of eight by two blocks. The design of the array of lines carried by sheet 196 is different from that shown in FIG. 2 in such a way that the lines emerge perpendicular to those of sheet 195. The design of this array (not shown) can easily be imagined from the drawing shown. In addition, diagrammatic examples of these two designs are given in the patent application quoted in the introduction.

As apparent in FIG. 1, the antenna according to the present example includes two arrays of lines, each of them corresponding with one direction of polarization of the wave, in order that the antenna can operate with two different polarizations. One of them is formed by the dielectric sheet 195 carrying lines, placed between 2 identical pierced sheets 156, 157, sheets provided with separating studs on their internal surfaces. The second array is formed similarly by components 158, 196 and 159.

It is easy to understand that the separating studs 4 and 19 or 20 and 24 could also have been deposited by silk-screen printing on both surfaces of each sheet 195, 196, instead of being deposited on the metallic sheets 156 to 159. However, depositing on the sheets is much easier.

The manufacture of an antenna according to the invention is facilitated by the fact that a dielectric material that can be polymerized is used for the studs, and that it is only partially polymerized before assembling the components of the antenna. In this way this material remains adhesive when the sheets are brought into the desired position on either side of the dielectric sheets 195, 196 and then pressed against each other, enclosing the dielectric sheets, which joins the various layers to each other. Complete anaerobic polymerization is of course subsequently obtained, possibly accelerated by the application of heat. It is also possible to provide an additional mechanical means of perfecting this fixing. The dielectric material is for example an adhesive that can be polymerized in ultra-violet light, sold under the Trade name "Framet", reference LI 553. To it is added a load of transparent glass balls.

Figure 3:
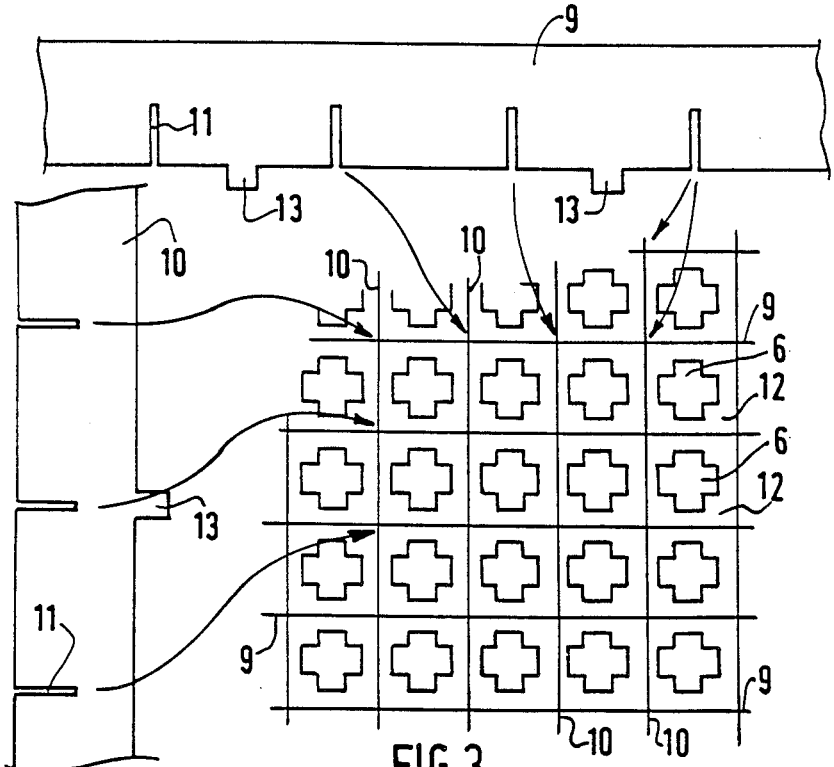
FIG. 3 shows a variant embodiment of the blocks forming a number of waveguides.

FIG. 3 shows a variant embodiment of the blocks forming a number of waveguides. According to this variant, the blocks are formed by the assembly of two series of walls. A first series of walls 9 is situated, perpendicularly to the plane of the antenna, between each line of cut-outs and a second series of walls 10 is situated in the same way between each column of cut-outs.

The two series thus assembled form a matrix of cells, of which each cell 12 forms a waveguide and corresponds with a cut-out 6 in the sheets. The walls 9 have slots 11 over half of their height and the walls 10 have similar slots over the other half of their height in order to allow their assembly in a way that is similar to that of the internal separators in cardboard packages.

The walls 9, 10 are produced from aluminium. Because of this the matrix of cells can cover the entire surface of the antenna at the same time, as its coefficient of expansion is the same as that of the sheets 156 to 159.

The fixing of this matrix of cells can be carried out by means of tabs, 13, cut out during the manufacture of the walls. In order to receive these tabs, holes 17 in FIG. 2 are advantageously replaced by rectangular holes (not shown), corresponding with the cross-section of the tabs 13 and into which these tabs are inserted, and then twisted. The matrix can also be joined to the sheet 156 by adhesive.

Figure 4:
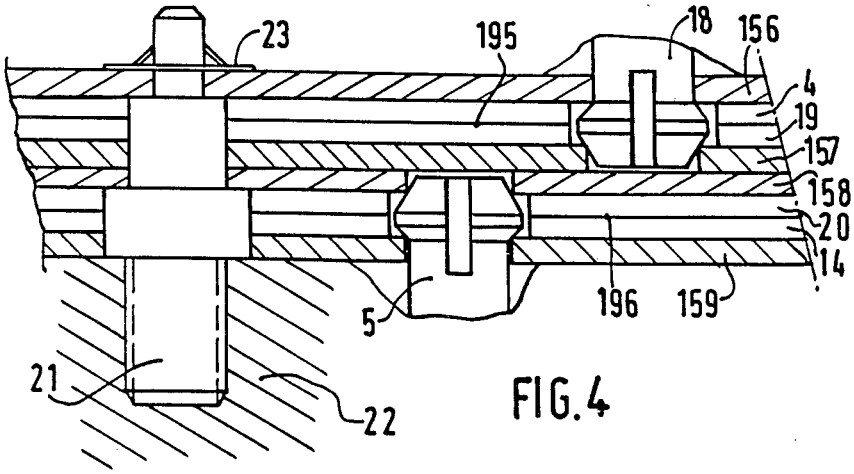
FIG. 4 shows an example of a method of fixing the components of the antenna to each other.

FIG. 4 shows in detail methods of assembling the antenna. The four sheets 156, 157, 158 and 159 are again found here, provided with separating areas 4, 19, 20 and 14 respectively and enclosing sheets 195 and 196. The pin 18, belonging to the upper block of open waveguides, is fixed in a hole in the sheets 156 and 157. The pin 5, belonging to the lower block of closed waveguides, is fixed in a hole in sheets 159 and 158. Sheet 157 is applied directly against sheet 158. The antenna assembly is mounted on a chassis of which a small section is shown cross-hatched at 22. A pin 21 is fixed in the material of the chassis and the stack forming the antenna, provided with suitable holes, is fixed to the chassis using such pins and clips 23 force-fitted onto the pins.

Figure 5:
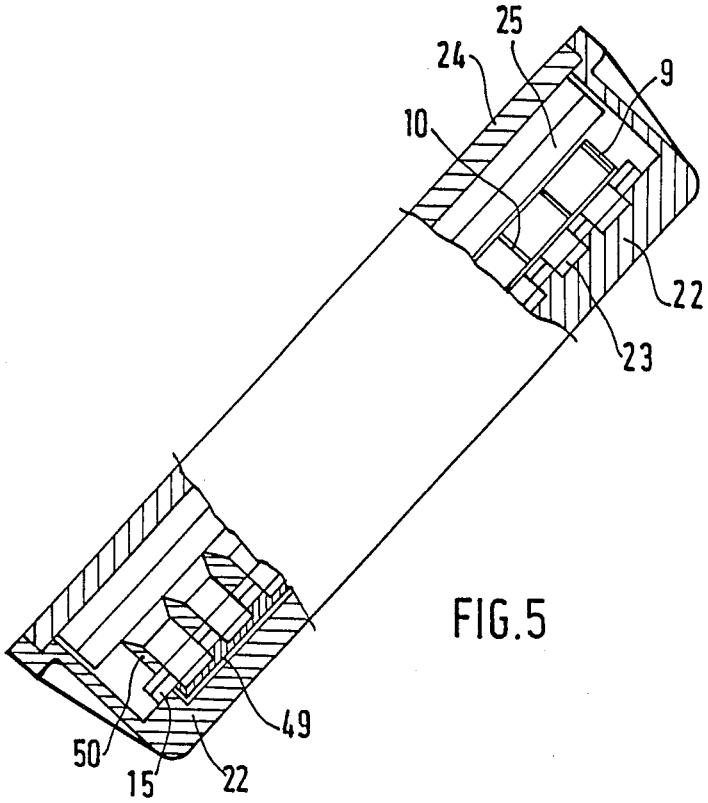
FIG. 5 shows, partially in cross-section, a complete antenna.

FIG. 5 shows a complete antenna: the two parts in cross-section each show a variant embodiment. It is obvious that in practice these two variants would not appear together in a same antenna!

At the bottom left, the variant is the same as that described in FIGS. 1 and 4. In this figure the same references, 22 for the chassis, 49 and 50 for the waveguide blocks, appear again. Reference 15 includes the stack of sheets previously referenced 156 to 159. The antenna is housed in a protective casing, whose rear wall 22 forms the abovementioned chassis.

At the top right, the waveguide block is formed by the walls 9, 10, described with reference to FIG. 3. The closed waveguides placed at the rear of the stack 15 are formed by cut-outs 23 cut directly into the surface of the chassis 22, which is here the rear wall of the casing, applied to the rear surface of the rear sheet of the stack 15.

In front of the previously described components there is placed a depolarizer 25 intended to allow a functioning of the antenna in circular polarization and which is not part of the invention, and a cover 24 to close the casing, this cover of course being transparent to electromagnetic radiation, made from polyurethane for example.

The casing is produced by moulding. It can be metallic, but it is more advantageous to produce it in the same material as the cover 24, which enables the economic production of an assembly which is sealed with this cover by adhesive. In this case the parts forming the closed rear waveguides 23 must be made to be surface conducting, for example by means of conductive paint (loaded with conductive particles) deposited for example by spraying. These conductive particles are simply earthed by their contact with the rear sheets of the stack.

It is obvious that the combinations of variants shown are not exclusive and that subdivided blocks 50 can be used as well with rear waveguides 23 incorporated in the casing, or a front block based on plane walls 9, 10, with a rear block 49. This rear block can also be produced based on plane walls similar to those in FIG. 3, the closing of the guides then being provided by the surface of the chassis on which they are applied.

The present invention is of course not limited to an antenna with two systems of microwave lines. If a plane antenna is required to receive or transmit microwave signals with just one type of polarization, the said antenna can be obtained from that which has been previously described simply by omitting the superfluous components.

Finally, it is obvious that the application of the invention to the reception of 12 gigahertz television signals retransmitted by satellite is not limiting. On the one hand, the invention is applicable to all kinds of purely terrestrial microwave transmission systems and, on the other hand, the choice of an example of application at the frequency of 12 gigahertz is not exclusive of any other operating frequency, in the microwave range, associated with such other envisaged application. The dimensions of the waveguides and their spacing would then of course have to be modified.

What is claimed is:

1. A planar high-frequency antenna including, in order:

a. a rigid block of material having a plurality of openings therethrough bounded by conductive surfaces defining respective waveguides;

b. a first flexible sheet having openings therethrough aligned with the openings in the rigid block and bounded by conductive surfaces defining continuations of the respective waveguides;

c. a second flexible sheet of dielectric material bearing a network of strip conductors having ends terminating in the waveguides;

d. a third flexible sheet having openings therethrough aligned with the openings in the first flexible sheet and bounded by conductive surfaces defining continuations of the respective waveguides; and e. a rigid chassis for supporting the sheets;

said antenna further including a first pattern of separating studs disposed between the first and second sheets, and a corresponding second pattern of separating studs disposed between the second and third sheets, said patterns of studs being deposited on respective ones of the flexible sheets and being arranged to inflexibly secure the second flexible sheet between solid portions of the rigid block and the rigid chassis.

2. An antenna as in claim 1 where the patterns of separating studs comprise silk-screen-deposited dielectric material.

3. An antenna as in claim 1 or 2 where the openings are cross shaped.

4. An antenna as in claim 1 or 2 where the openings are circular.

5. An antenna as in claim 1 or 2 where the patterns of separating studs are formed from particles of dielectric material.

6. An antenna as in claim 5 where the particles are transparent.

7. An antenna as in claim 1 or 2 comprising a plurality of the rigid blocks and a single chassis.

8. An antenna as in claim 1 or 2 where the rigid block is formed from a plurality of assembled strips.

9. An antenna as in claim 1 or 2 where the chassis includes indentations aligned with the openings in the third flexible sheet for forming terminations of the waveguides.

10. An antenna as in claim 1 or 2 comprising a housing, the chassis being formed in a wall of said housing.

* * * * *